US005532725A

United States Patent [19]

Martin

[11] Patent Number: 5,532,725

[45] Date of Patent: Jul. 2, 1996

[54] TRANSPARENT MEDIA FOR MINIMIZING CURL DURING PRINTING OF HIGH DENSITY THERMAL DYE TRANSFER IMAGES

[75] Inventor: Thomas W. Martin, Rochester, N.Y.

[73] Assignee: Eastman Kodak Company, Rochester, N.Y.

[21] Appl. No.: 146,270

[22] Filed: Oct. 29, 1993

[51] Int. Cl.[6] ..... B41M 5/40

[52] U.S. Cl. ..... 347/221; 346/135.1

[58] Field of Search ..... 347/221, 171; 346/135.1; 400/578; 503/227

[56] References Cited

U.S. PATENT DOCUMENTS

| | | | |
|---|---|---|---|
| 4,892,994 | 1/1990 | Tsuchiya et al. | 219/216 |
| 5,220,351 | 6/1993 | Martin et al. | 346/76 PH |

*Primary Examiner*—Huan H. Tran
*Attorney, Agent, or Firm*—Milton S. Sales

[57] ABSTRACT

A transparency dye receiver media for minimizing curl during recept of dye transfer images in a thermal printing process includes a transparent support having a thickness between about 5.5 mil and about 6.5 mil and a dye receiver layer on a surface of said support. Preferably, the transparent support has a thickness of about 5.8 mil. The transparent support has a thickness in inches approximately equal to the cube root of $$C^*F_H R^{*2}\theta^3/4Eb(57.3)^3(1-\cos\theta/2),$$

where:

$C^*$ is a constant for a given dye receiver support thickness, $F_H$ is the load on the receiver media from the printhead in pounds, $R^*$ is the radius of the bend during printing in inches, $\theta$ is the arc of bending of the receiver media during printing in degrees, E is Young's Modulus in psi, and b is the width of printhead in inches.

6 Claims, 3 Drawing Sheets

| EXAMPLE | SUPPORT THICKNESS | Fc (lb) | Fb (lb) | Curl (cm) |
|---|---|---|---|---|
| | | | | |
| 1 | 4.7mil | 0.72 | 0.37 | +3.10 |
| 2 | 6.0mil | 0.61 | 0.78 | -1.20 |
| 3 | 6.5mil | 0.56 | 0.99 | -1.65 |
| 4 | 7.0mil | 0.48 | 1.24 | -3.00 |

TRANSPARENT MEDIA FOR MINIMIZING CURL DURING PRINTING OF HIGH DENSITY THERMAL DYE TRANSFER IMAGES

BACKGROUND OF THE INVENTION

1. Technical Field

This invention relates generally to thermal print media, and more particularly to minimizing the curl induced into transparent media during thermal printing.

2. Background Art

As is well known in the art, a thermal printhead utilizes a row of closely spaced electrically-resistive heater elements which are selectively energized to record data in hard copy form. To produce a high quality continuous-tone print using the thermal printing process, a dye donor media (sheet or web) and dye receiver media (sheet or web) are passed through the nip formed between a thermal printhead and a platen while heat is selectively applied to the dye donor sheet by image-wise energizing the heater elements that make up the thermal printhead. Dye is transferred from the dye donor media to the dye receiver media, which includes a dye receiver layer coated on an opaque or transparent support for reflective prints or for transparencies, respectively. A transparent support may be comprised of any suitable light transmissive material such as polyester film.

Projection transparency dye receiver media exhibits an objectionable amount of curl (also referred to as warpage) as a result of heating the surface of the dye receiver media nearest to the thermal head during dye transfer. The curl problem becomes severe as attempts are made to print transparencies with high optical image densities ($D_{max}$ of about 1.8 or greater) which require the support surface nearest to the print head to experience temperatures significantly higher than the glass transition temperature ($T_G$) of most common transparent support materials employed in transparencies. The curl of a projection transparency affects the quality of projected images, and it is preferred to have the finished projection transparency as flat as possible when placed upon a flat surface.

Prior art approaches to controlling curl include the use of synthetic paper dye receiver media of at least three plies, each having different Cobb sizing degrees or internal bond strength to prevent curling when used for facsimile, thermal printing, etc. Another prior art approach involves the use of a paper support containing pigment and a rubbery polymer latex material providing a material that would yield reduced curl when imaged with a thermal head or heat pin. Still another curl prevention technique involves coating the surface of the substrate with a layer of resin that is neither heat expandable or contractible; preferably an acrylic resin. These approaches, however, are unsuitable for transparencies because they increase opacity and/or add additional expense to the cost of manufacturing the media due to the addition of materials and/or production steps.

U.S. Pat. No. 4,892,994, which issued to Masaru Tsuchiya et al. on Jan. 9, 1990, discloses a guide passage at the outlet of a thermal transfer step. The guide passages bend in the direction opposite to the induced curl to reduce the effect of induced curl in the finished print. It would be desirable to have a method for producing transparencies that prevent the formation of curl, rather than apparatus that reduces curl once formed.

Commonly assigned U.S. Pat. No. 5,220,351, which issued to Martin et al on Jun. 15, 1993, discloses a method for minimizing curl of transparent media during printing in a thermal printer, comprises wrapping the transparent media about a circumference of a printer platen so that the transparent media contacts the circumference for an arc angle of between about 60 degrees to about 230 degrees. While this is effective in reducing curl, it does require a re-design of the media transport path, and is therefore not suitable for existing printers. It would be advantageous to provide a method for minimizing curl of transparent media during thermal printing with existing printers.

SUMMARY OF THE INVENTION

The present invention is directed to overcoming one or more of the problems set forth above. Briefly summarized, according to one aspect of the present invention, a transparency dye receiver media for minimizing curl during receipt of dye transfer images in a thermal printing process includes a transparent support having a thickness between about 5.5 mil and about 6.5 mil and a dye receiver layer on a surface of said support. Preferably, the transparent support has a thickness of about 5.8 mil.

In a preferred embodiment of the present invention, the dye receiver media transparent support is polyester film, such as, for example, polyethyleneteraphthalate film in sheet form.

According to another feature of the present invention, a transparency dye receiver media for minimizing curl during receipt of dye transfer images in a thermal printing process includes a transparent support having a thickness in inches approximately equal to the cube root of $$C^*F_H R^{*2}\theta^3/4Eb(57.3)^3(1-\cos\theta/2),$$

where:

$C^*$ is a constant for a given dye receiver support thickness, $F_H$ is the load on the receiver media from the printhead in pounds, $R^*$ is the radius of the bend during printing in inches, $\theta$ is the arc of bending of the receiver media during printing in degrees, E is Young's Modulus in psi, and b is the width of printhead in inches.

According to still another feature of the present invention, a thermal printing system includes (i) transparency dye receiver media having a transparent support with a thickness between about 5.5 mil and about 6.5 mil and (ii) a thermal printer having a thermal head, a platen that supports dye receiver media as dye is transferred to the dye receiver media, and means for defining a dye receiver media path which induces a bend in the dye receiver media of about 1.5 cm and an arc of bending of about 120 degrees during printing. Preferably, the transparent support has a thickness of about 5.8 mil, and is polyester film such as polyethyleneteraphthalate sheet film.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
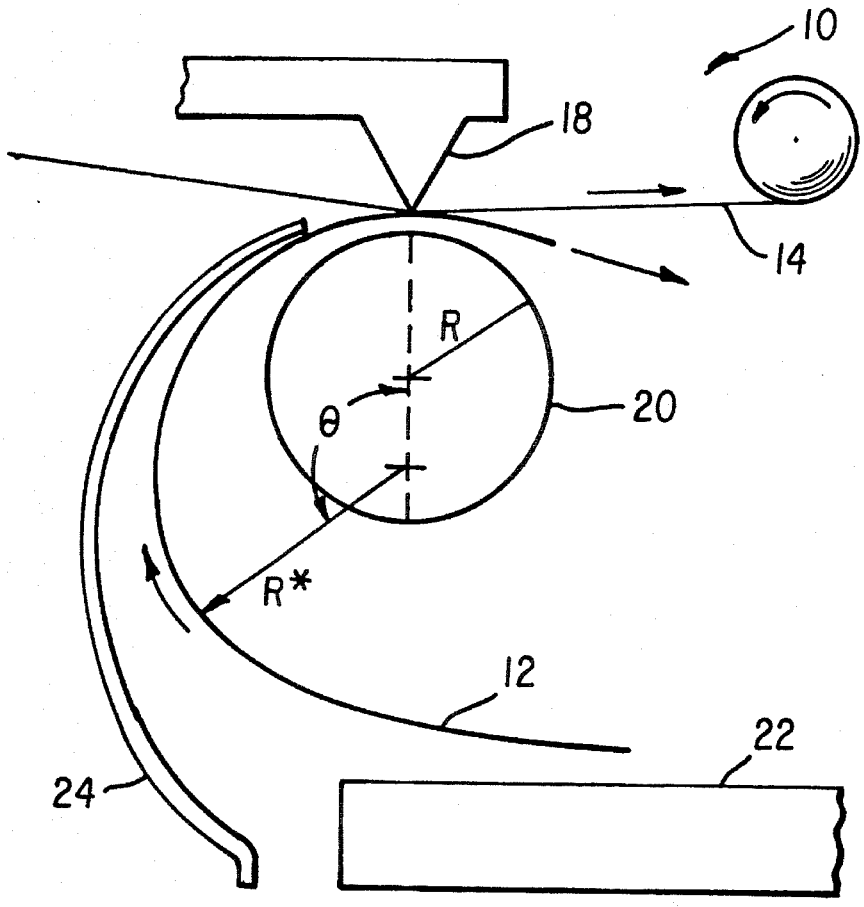
FIG. 1 is a simplified perspective view of a preferred embodiment of a thermal printer mechanism during a printing cycle.

Referring now to the drawings, in which like numerals indicate like elements throughout the several figures, FIG. 1 illustrates a thermal printer 10, dye receiver media 12, and dye donor media 14 with take-up roll 16. Thermal printer 10 includes a thermal head 18, a platen 20 that supports dye receiver media 12 as dye is transferred to the dye receiver media, and a dye receiver media supply 22.

Figure 2:
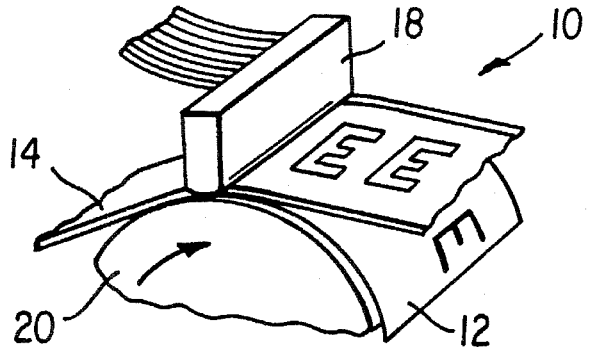
FIG. 2 is an enlarged schematic perspective view of a detail of the thermal printer mechanism of FIG. 1.

Normal thermal printer operations include loading dye receiver media, printing information upon the dye receiver media, and ejecting the finished print. In the loading phase, printhead 18 is moved away from platen 20, and a sheet of dye receiver media is advanced from supply 22, along a curved guide member 24, to a printing location between the printhead and the platen. Printhead 18 may be moved to a print position, whereat dye receiver media 12 rests against the circumference of platen 20. At the print position, printhead 18 is close enough to the platen to thermally transfer dye from dye donor media 14 to dye receiver media 12 when the printhead heater elements are activated; as illustrated in FIG. 2.

When image formation is effected using these dye receiver sheets, the printed sheets generally exhibit a certain amount of curl as the result of heating of the dye receiver sheet surface nearest to the thermal head during dye transfer. The curl becomes a severe problem as attempts are made to print transparencies with high image densities ($D_{max}$ in the range of, say, 1.8 and greater). Such high densities require the support surface nearest to the print head to experience temperatures which are significantly higher than the glass transition temperature $T_G$ of most common transparent support materials used to produce transparencies.

Figure 3:
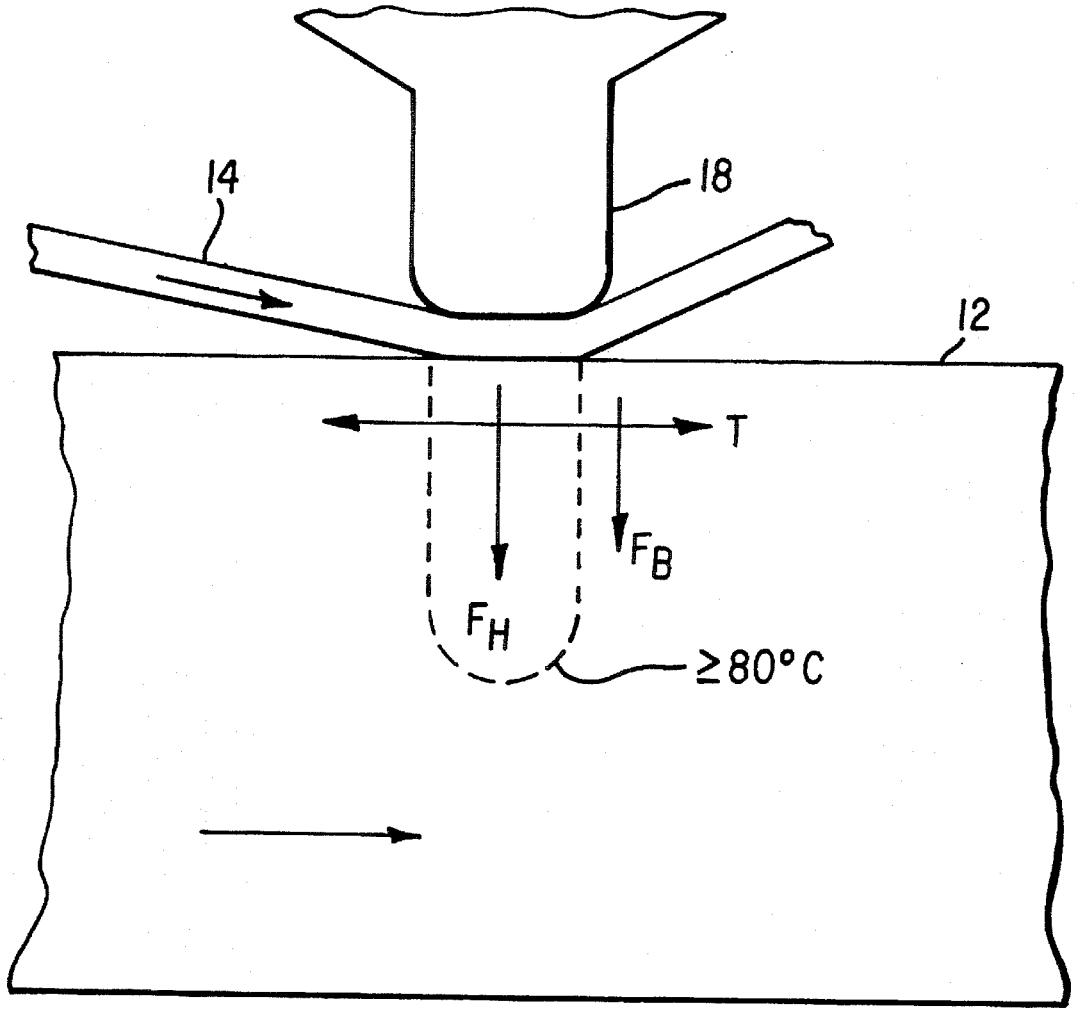
FIG. 3 is an enlarged schematic side view of a detail of the thermal printer and media of FIGS. 1 and 2.

FIG. 3 is a schematic representation of the side view of the nip formed between thermal printhead 18 and platen 20 as media is passed through the nip during the printing operation. While the media is in the nip, it is under both a compressive force due to a load $F_H$ from the printhead and a tensile force $F_B$ due to bending tension T. A volume of the dye receiver media, represented within the dashed lines in FIG. 3, extends for a significant depth into the dye receiver media. Material within this volume will be at a temperature above its glass transition temperature $T_G$ when high density images are being produced. As the media passes from under the nip and the media cools, distortions caused by forces $F_H$ and $F_B$ are frozen into the dye receiver media.

If forces $F_H$ and $F_B$ are not of similar magnitude, considerable thermal curl will result. This can cause problems with dye receiver sheet transport and re-registration when printing color images in a printer. In addition, the curl of a projection transparency dye receiver sheet affects the quality of the projected image. Thus, the preferred situation is to have the finished projection transparency be as flat as possible when placed upon a flat surface. The present invention provides a method for producing high image density projection transparencies with little to no curl by thermal dye transfer printing.

The stress equation developed to describe compressive stresses $F_C$ is:

$$|F_C|=C^*F_H \quad (1)$$

where:

(a) $F_H$ is the thermal head load in pounds; and (b) C* is a constant for a given dye receiver support thickness. It is related to the compression equation for the support material, and is determined experimentally.

The stress equation developed to describe bending stresses is:

$$F_B=C(1-\cos\theta/2)/R^{*2}\theta^3 \quad (2)$$

where:

$F_B$=curl force due to bending in pounds;

θ=arc of bending during printing in degrees;

R*=radius of the bend during printing in inches; and $C=4Ea^3b(57.3)^3$, where:

(a) E is Young's Modulus in psi;

(b) a is the thickness of the dye receiver support in inches;

(c) b is the width of printhead in inches; and (d) the constant 57.3 is the conversion of radians to degrees.

Thus, C is a constant for a given dye receiver support material and thickness; and is determined from the center-loaded beam strength equation. Since the heated image area is the same for both equations (1) and (2), a balance between the head compression force $F_C$ and the bending force $F_B$ will result in minimal post printed curl of transparent prints produced in a thermal printer.

Accordingly, for a given printer configuration with predetermined head load $F_H$, dye receiver bend radius R*, and dye receiver bending arc θ, and for a given dye receiver support material; an appropriate thickness can be selected for the dye receiver support. That is, a thickness that satisfies the force or stress balance criteria to thereby provide transparencies with little to no post printed curl.

Figures 4, 5:
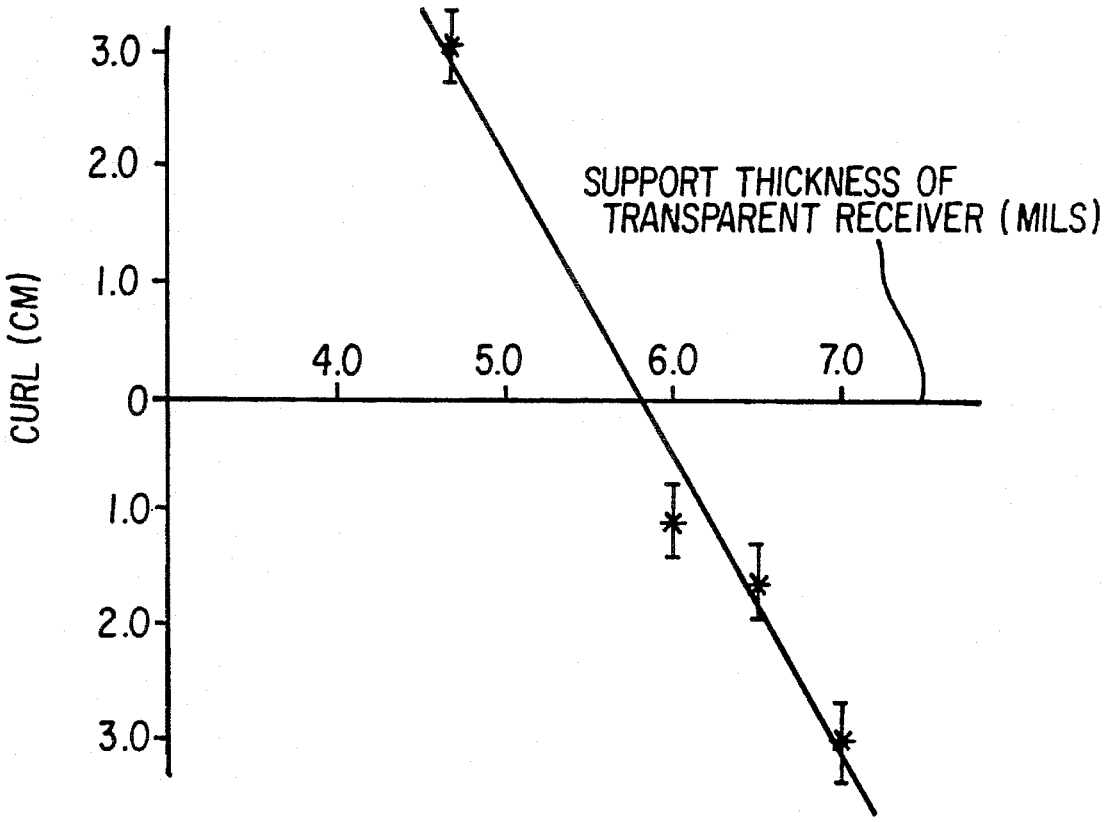
FIG. 4 is a chart showing test results.
FIG. 5 is a graphical representation of the results shown in FIG. 4.

The results obtained from a variety of dye receiver sheets printed with and without bending away from the thermal printhead during printing are summarized in the table of FIG. 4. In the tests, the product polyethyleneteraphthalate, sold under the trademark "ESTAR" was used as the projection transparency dye receiver supports. ESTAR polyethyleneteraphthalate supports were coated with dye receiver formulations. ESTAR polyethyleneteraphthalate supports of 4.7, 6.0, 6.5, and 7.0 mil thicknesses were evaluated for the amount of curl produced when printed in each thermal printer configuration tested. Dye receiver sheet dimensions were page size; that is, 8.5" by 11". A uniform area, 8" by 9.6", was printed to a neutral transmission density of about 1.8 on each test sample.

The value of constant C* for 4.7 mil ESTAR is 0.06; and for 7.0 mil ESTAR, C* is 0.04. Young's Modulus E for ESTAR is 670,000 psi. The value of constant C in equation (2) is 445,000 for 4.7 mil ESTAR, 925,700 for 6.0 mil ESTAR, 1,177,000 for 6.5 mil ESTAR, and 1,470,000 for 7.0 mil ESTAR.

The preferred thermal printer configuration used for these tests included a capstan drive system with a platen radius R of 1.0 cm, a radius of bend R* during printing of 1.5 cm, and an arc of bending during printing of 120 degrees. The results set forth in the table of FIG. 4 are illustrated in graphical form in FIG. 5.

It can now be appreciated that there has been presented a method for controlling the curl of high density images on transparent media for thermal dye transfer printers. According to that method, it has been determined that for thermal printing on a printer having a platen radius R of 1.0 cm, a radius of bend R* during printing of 1.5 cm, and an arc of bending during printing of 120 degrees, superior curl results are obtained by a polyethyleneteraphthalate based dye receiver sheet support thickness between about 5.0 mil and 6.5 mil; and that the optimum thickness for a polyethyleneteraphthalate based dye receiver sheet is about 5.8 mil. Generally, we have found that manufacturing and measurement tolerances can be held to about 0.2 mil. Coatings will add, say, 0.6 mil to the thickness of the receiver sheet.

While the invention has been described with particular reference to the preferred embodiments, it will be understood by those skilled in the art that various changes may be made and equivalents may be substituted for elements of the preferred embodiments without departing from the invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. Transparency dye receiver media for minimizing curl during receipt of dye transfer images in a thermal printing process in which the receiver media is passed through a nip formed between a thermal printhead and a platen while heat is selectively applied to the media by image-wise energization of heater elements that make up the thermal printhead, said receiver media comprising:

a transparent support having a thickness in inches approximately equal to the cube root of $$C^*F_H R^{*2}\theta^3/4Eb(57.3)^3(1-\cos\theta/2),$$

where:

$C^*$ is a constant for a given dye receiver support thickness, $F_H$ is the load on the receiver media from the printhead in pounds, $R^*$ is the radius of the bend during printing in inches, $\theta$ is the arc of bending of the receiver media during printing in degrees, E is Young's Modulus in psi, and b is the width of printhead in inches; and a dye receiver layer on one surface of said support.

2. Transparency dye receiver media as set forth in claim 1 wherein said transparent support has a thickness between about 5.5 mil and about 6.5 mil.

3. Transparency dye receiver media as set forth in claim 2, wherein the transparent support has a thickness of about 5.8 mil.

4. Transparency dye receiver media as set forth in claim 2, wherein the transparent support is polyester film.

5. Transparency dye receiver media as set forth in claim 2, wherein the transparent support is polyethyleneteraphthalate film.

6. Transparency dye receiver media as set forth in claim 2, wherein the dye receiver media is in sheet form.

* * * * *